US006940465B2

(12) United States Patent
Göttl et al.

(10) Patent No.: US 6,940,465 B2
(45) Date of Patent: Sep. 6, 2005

(54) DUAL-POLARIZED DIPOLE ANTENNA ELEMENT

(75) Inventors: Maximilian Göttl, Frasdorf (DE); Robert Kinker, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 70 days.

(21) Appl. No.: 10/431,592

(22) Filed: May 8, 2003

(65) Prior Publication Data

US 2004/0222937 A1 Nov. 11, 2004

(51) Int. Cl.[7] ..... H01Q 21/26
(52) U.S. Cl. ..... 343/797; 343/815
(58) Field of Search ..... 343/795, 797, 343/815–819

(56) References Cited

U.S. PATENT DOCUMENTS

| | | | | |
|---|---|---|---|---|
| 2,465,379 A | | 3/1949 | Kandoian | 343/726 |
| 4,062,019 A | | 12/1977 | Woodward et al. | 343/797 |
| 4,184,163 A | | 1/1980 | Woodward | 343/742 |
| 4,434,425 A | | 2/1984 | Barbano | 343/797 |
| 5,434,575 A | | 7/1995 | Jelinek et al. | 342/365 |
| 5,796,372 A | | 8/1998 | Elliot | 343/797 |
| 5,838,282 A | | 11/1998 | Lalezari et al. | 343/797 |
| 5,977,929 A | | 11/1999 | Ryken | 343/797 |
| 6,028,563 A | | 2/2000 | Higgins | 343/797 |
| 6,195,063 B1 | | 2/2001 | Gabriel et al. | 343/797 |
| 6,313,809 B1 | | 11/2001 | Gabriel et al. | 343/797 |
| 6,597,324 B2 | * | 7/2003 | Eriksson | 343/795 |
| 2002/0084942 A1 | | 7/2002 | Tsai et al. | 343/795 |
| 2002/0163476 A1 | | 11/2002 | Eriksson | 343/815 |

FOREIGN PATENT DOCUMENTS

| | | |
|---|---|---|
| DE | 196 27 015 | 1/1998 |
| DE | 197 22 742 | 12/1998 |
| DE | 198 29 714 A1 | 1/1999 |
| DE | A-198 23 749 | 12/1999 |
| DE | A-198 23 750 | 12/1999 |
| EP | 0 178 877 | 4/1986 |
| EP | 0 685 900 | 12/1995 |
| EP | A-1 082 781 | 3/2001 |
| EP | A-1 082 782 | 3/2001 |
| FR | 2 736 212 | 1/1997 |
| FR | 2 751 471 | 1/1998 |
| GB | 2 303 740 A | 2/1997 |
| GB | 2 316 233 A | 2/1998 |
| WO | WO 00/39894 | 7/2000 |

OTHER PUBLICATIONS

Antenna Engineering Handbook, 2$^{nd}$ edition, pp. 4–12–4–15 and pp. 29–5–29–12.
RCA Review, Experimental determined radiation characteristics of conical and triangular antennas, vol. 13, pp. 425–452 (1952).
Antenna Theory, chapter 9, "Broadband Dipoles and Matching Techniques," pp. 441–452Wiley, New York (1997).
IEEE Transactions of Antennas and propagation, vol. 50, No. 3, Mar. 2002.
IEEE Transactions of Antennas and propagation, vol. 50, No. 2, Feb. 2002.
The Handbook of antenna design, vol. 2 (electromagnetic waves; 16).
"Antennen—zweiter Teil" von Adolf Heilmann, Mannheim, 1970.
"Antennas—Secon Edition", John D. Kraus.

* cited by examiner

*Primary Examiner*—Michael C. Wimer
(74) *Attorney, Agent, or Firm*—Nixon & Vanderhye P.C.

(57) ABSTRACT

An improved dual-polarized antenna element arrangement has half-dipole components which interact with each other and, from the electrical point of view, each form of dipole half connected via an electrical connector or a transverse strut, to be precise offset with respect to the outer corner region in the direction of the center of the antenna element arrangement.

14 Claims, 11 Drawing Sheets

DUAL-POLARIZED DIPOLE ANTENNA ELEMENT

FIELD

The technology herein relates to a dipole antenna element.

BACKGROUND AND SUMMARY

A dipole antenna element has been disclosed, for example, in WO 00/39894, or likewise in U.S. Pat. No. 6,313,809 B1. This is a dual-polarized antenna element arrangement having two or more dipoles which, in a plan view, are each arranged in the form of a dipole square, or at least similar to a dipole square. The antenna element arrangement which is in the form of a dipole square or the antenna element arrangement which is at least approximately a dipole square (in a plan view as seen from its exterior) is connected and fed such that, from the electrical point of view, the antenna element arrangement transmits and receives in two mutually perpendicular polarization planes, which run parallel to the mutually perpendicular diagonals which are formed by the antenna element arrangement.

A dual-polarized antenna element arrangement such as this has been proven well in practice and has major advantages over previous antenna element arrangements.

The exemplary illustrative non-limiting technology herein provides a further improved antenna element arrangement which has even better characteristics particularly in terms of a broad bandwidth.

It must be regarded as more than surprising that it has been possible to considerably further improve the broad bandwidth of an antenna element arrangement of this generic type, by means of simple technical measures. Specifically, according to exemplary illustrative non-limiting arrangements, this can be achieved by each of the four dipole halves that are produced from the electrical point of view (from the antenna element arrangement which transmits and receives in the manner of a dipole cruciform from the electrical point of view) each has an electrically conductive transverse strut, which runs transversely and preferably at right angles to the electrical polarization plane. The antenna element arrangement which forms this generic type is thus distinguished in that each dipole half is formed by two mutually perpendicular, or at least approximately mutually perpendicular, half-dipole components. The half-dipole components may be conductively connected at their end. However, they may also be only mechanically fixed with respect to one another and may have an electrically conductive connection in a strut or in the form of a strut, which is located offset with respect to their end as mentioned above (and at which they may be, but need not be, fixed with respect to one another, as mentioned).

It has now been found that the measures explained above allow the broad bandwidth of an antenna to be considerably further improved.

In one exemplary non-limiting illustrative implementation, this cross connection is in this case in the form of a transverse strut.

The extensions of the half-dipole components, which run at an angle and preferably at right angles to one another, may be as mentioned conductively or mechanically fixed to one another at their intersection point, which is also referred to in the following text as their outer corner point. Those ends of the two half-dipole components which are in each case on the inside with respect to this and which form the respective half-dipole are preferably used as connecting points, which are connected to one another by an electrical cable or an electrically conductive structure. In principle, the electrical cross connection may, however, also be arranged or electrically linked at some other point between the two respectively interacting half-dipole components. The electrical cross connection or transverse strut is preferably in the form of a straight transverse strut, which is located at right angles to the corresponding polarization plane. However, in a plan view, it may also be at least slightly convex or concave, or may be formed with other curved sections. It may likewise also be at least partially run other than in the plane in which the individual half-dipole components are located. In other words, the transverse strut may also run at a distance from this plane, somewhat above or below it, with the plane which has been mentioned above generally being that plane in which all the half-dipole components are arranged. This plane is normally parallel to the reflector plane.

The respectively interacting half-dipole components may be electrically firmly connected in the outer corner regions, or else may be only mechanically connected there via a nonconductive electrical connecting piece. The corner regions may likewise be open.

The cross connection or transverse strut that has been explained may, however, likewise be in the form of a flat element. In this exemplary case, an opening area preferably remains in the outer corner region, passes through the flat arrangement of the dipole half formed in this way, and is preferably larger than at least 20% of the total area of a respective dipole half. This opening area, which passes through the dipole surface, opens in a separation space between the outer half-dipole components, which run towards one another, can also be interpreted as edge boundaries of the respective dipole half. In this exemplary non-limiting illustrative implementation, the outer half-dipole components are not electrically connected to one another in their outer corner region.

In this exemplary non-limiting illustrative implementation, the dipole halves are formed from flat elements, with the boundary edges (which point towards one another) of two adjacent dipole halves which are associated with a different polarization being arranged symmetrically, and in this case preferably running parallel to one another. In a plan view, the flat dipole halves in this case each have a square shape or a shape similar to a square, with the respective outer boundaries which are located on the outside and run towards one another in their outer corner regions ending at least at a short distance from one another and having a connection through the separation area formed in this way to an opening or aperture area which passes through the flat dipole half. This opening area should have at least 20% of the area of the dipole halves. Otherwise, the flat dipole halves may also have further openings, for example even being in the form of grids or meshes. The flat elements of the dipole halves thus carry out that function which, in the exemplary non-limiting illustrative implementation, is carried out by the electrical cross connections or transverse struts mentioned there.

The dual-polarized antenna having flat antenna elements has in principle also been disclosed in U.S. Pat. No. 6,028,563. The dipole arms or dipole halves in this case are triangular, however, that is to say the dipole halves do not themselves have a square structure. Furthermore, that flat dipole halves which are known from the abovementioned prior art are not provided with apertures.

BRIEF DESCRIPTION OF THE DRAWINGS

Further advantages, details and features of the exemplary non-limiting illustrative implementation will become evident in the following text from the exemplary arrangements which are illustrated by drawings, with reference being made to the entire disclosure content of WO 00/39894 and U.S. Pat. No. 6,313,809 B1, which is parallel to it, and being included in the content of this application. In the attached figures.

DETAILED DESCRIPTION

Figure 1:
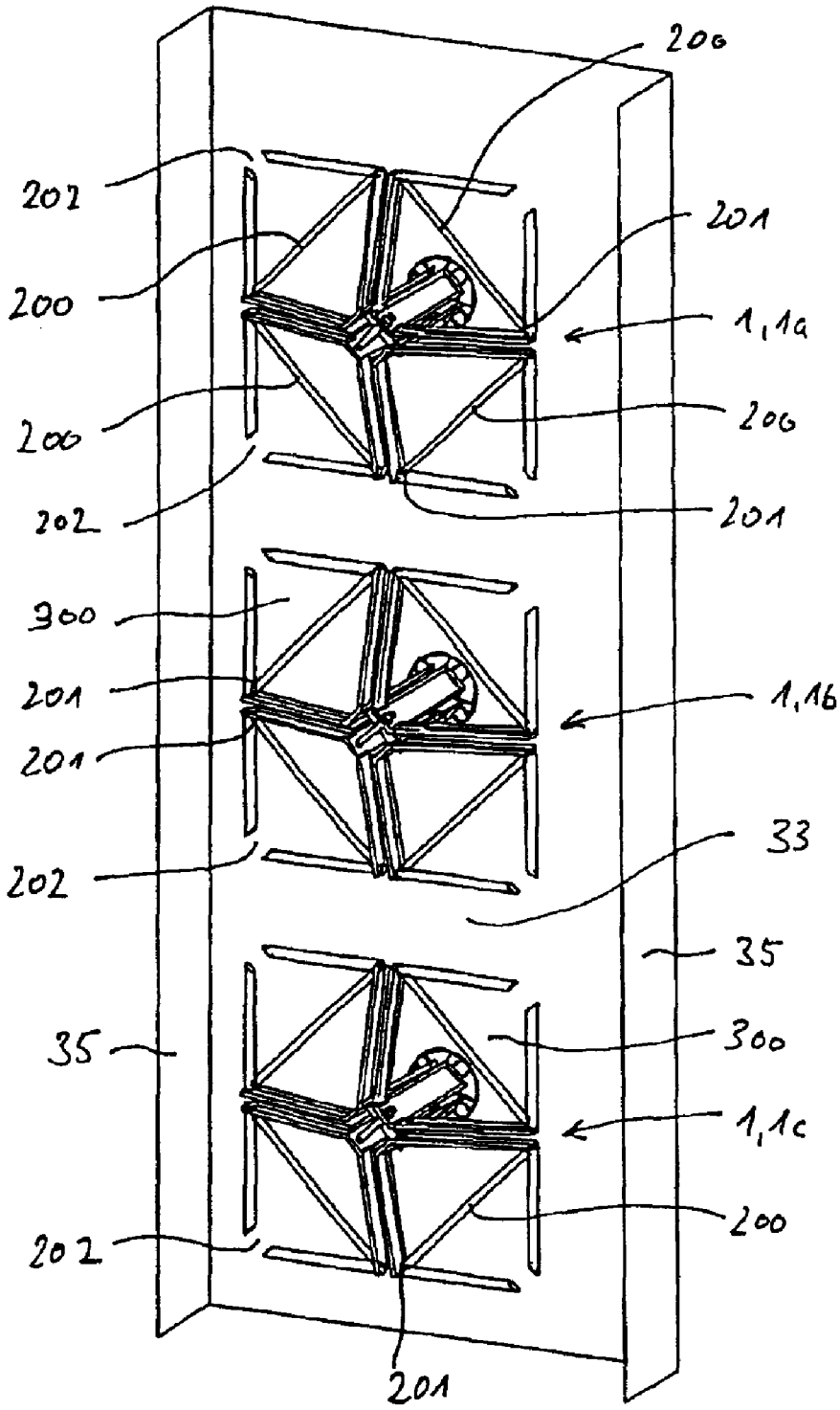
FIG. 1 shows a perspective illustration of an exemplary non-limiting illustrative antenna array having three dual-polarized antenna element arrangements arranged vertically one above the other.

FIG. 1 shows a schematic perspective plan view of an antenna array with three dual-polarized dipole antenna elements 1 arranged one above the other, with the dipole antenna element 1, in a plan view, being in the form of a dipole square, or similar to a dipole square. Although the half-dipole components which will be explained in more detail in the following text are aligned or appear aligned vertically or horizontally when the antenna array is aligned vertically, the dipole antenna elements which have been mentioned transmit and receive, from the electrical point of view, in an alignment of +45° and −45° with respect to the horizontal.

The three dipoles 1 which have been mentioned are arranged in front of a reflector plate 33, in the exemplary non-limiting illustrative implementation shown in FIG. 1. On its opposite side outer edges, the reflector plate is provided, for example, with electrically conductive edge sections 35 which run transversely with respect to the reflector plane, and preferably at right angles to the reflector plane.

FIG. 1 also shows that the dipole square may have a free section at the outer boundary corners 202, so that the half-dipole components, which will be explained in detail in the following text, end at a distance from one another and are not connected to one another there. This is shown for the uppermost antenna element arrangement 1*a*.

The antenna element arrangements 1 could also be designed such that the half-dipole components are electrically conductively connected to one another in the corner regions 202, preferably in the form of a fixed mechanical connection.

The half-dipole halves could likewise be connected to one another only mechanically in the outer corner regions, that is to say by means of nonconductive attachments or inserts in the outer corner region. This outer corner region is thus defined by the two half-dipole components which belong to one electrical dipole half and intersect in their outer corner region, or at least whose extensions intersect in what is referred to as an outer corner region. The half-dipole components may end at a distance from one another in this corner region, so that their outer end regions do not touch this outer corner region. However, their outer end regions may also be mechanically connected to one another via a mechanical fixing, and may also be electrically connected to one another by an electrical connection.

In all three antenna element arrangements 1*a* to 1*c*, an electrical cross connection 200 is in each case formed, located offset inward from the corner regions and transversely with respect to the diagonal alignment of the transmission and reception or polarization planes. This electrical cross connection 200 may preferably be in the form of an electrical transverse strut, which will likewise be described in more detail in the following text.

The dipole antenna element which is illustrated in the form of a schematic plan view in FIG. 2 and is illustrated in a somewhat more specific form in FIGS. 3 and 3*a*—and which will also be explained in detail in the following text—acts from the electrical point of view like a dipole which transmits and receives with a polarization of ±45° (by way of example like a cruciform dipole). The antenna element, which acts as a cruciform dipole 3 from the electrical point of view, is shown by dashed lines in FIG. 2. This antenna element, which from the electrical point of view acts as a cruciform dipole 3 and is aligned at ±45° with respect to the horizontal, is formed by an electrical dipole 3' (inclined in the ±45° direction) and a dipole 3" at right angles to it (inclined at −45° with respect to the horizontal). Each of the two dipoles 3' and 3" which are formed from the electrical point of view respectively comprises the associated dipole halves 3'*a* and 3'*b* for the dipole 3', as well as the dipole halves 3"*a* and 3"*b* for the dipole 3". From the physical design point of view, the electrically resultant dipole half 3'*a* is this case formed by two mutually perpendicular half-dipole components 114*b* and 111*a*. In the illustrated exemplary non-limiting illustrative implementation, the half-dipole components 114*b*, 111*a* end with their ends (which run towards one another at right angles) at a distance from one another. They could, however, also be connected there, to be precise both by means of an electrically conductive metallic connection and by insertion of an electrically nonconductive element or insulator, in order, for example, to ensure better mechanical robustness. The dipole halves may also be provided with smaller angles at the end. As a supplement to FIG. 2. FIG. 2*a* therefore shows the outer corner region 202 of this antenna element arrangement being closed.

In a corresponding way, the next dipole half 3"*b* in the clockwise direction of the electrical dipole 3" which is provided aligned at −45° from the electrical point of view is formed by the two half-dipole components 111*b* and 112*a*. The second dipole half 3'*b*, which is formed by the extension to the dipole half 3'*a*, is formed by the two half-dipole components 112*b*, 113*a*, and the fourth dipole half 3"*a* is formed by the two half-dipole components 113*b*, 114*a*, in an analogous manner.

As can be seen in the drawings, an electrical connection or transverse strut 200 is now provided or arranged with respect to each dipole half and, in the illustrated exemplary non-limiting illustrative implementation, is located transversely, that is to say in particular vertically, on the respective polarization plane 3' or 3". In this case, the strut 200 in each case connects two half-dipole components, namely the half-dipole components 114*b* and 111*a*, the half-dipole components 111*b* and 112*a*, the two half-dipole components 112*b* and 113*a*, and the half-dipole components 113*b* and 114*a*. This electrical connection or transverse strut 200 is in this case preferably arranged such that it assumes a maximum length, that is to say is preferably electrically and mechanically linked between the two diagonally opposite inner corner regions 201. These inner corner regions 201 are each formed by the end of the balanced lines 115 to 118, that is to say of the respectively associated line half 112*a* to 115*b*, and of the half-dipole components adjacent to them. In other words, these inner corner regions 201 are located opposite the outer corner region 202 in which two half-dipole components of one half-dipole each run towards one another, ending shortly in front of them, or being mechanically connected to one another via a mechanical fixing.

The half-dipole components, which are arranged as a dipole square, are now each fed by a balanced feed line 115, 116, 117 and 118. In this case, by way of example, the two half-dipole components 114*b* and 111*a*, that is to say in each case the adjacent half-dipole components which are aligned at right angles to one another, are excited in phase via a common feed point, in this case the feed point 15'. The connecting cables which are associated with these half-dipole components 114*b*, 111*a* are each formed from two cable halves 118*b* and 115*a* which, when considered individually, represent an unbalanced line with respect to a fictional zero potential 20. In a corresponding way, for example, the two next half-dipole components 111*b* and 112*a* are electrically connected, etc. via the cable halves 115*b* and 116*a*, respectively, to their common feed point 5". With this circuitry, the respectively associated balanced feed line is at the same time designed such that it provides the mechanical fixing for the dipoles, that is to say for the half-dipole components. In this case, by way of example, of the balanced line 115, the one unbalanced cable half 115*a* is fitted with the dipole half 111*a*, and the second cable half 115*b*, which is electrically isolated from the cable half 115*a* but preferably runs parallel to it, is fitted with the second dipole half 111*b*. Thus, in other words, the two associated unbalanced cable halves which belong to a balanced line 115 to 118 are in each case fitted with the two dipole halves, which are arranged as an axial extension with respect to one another, of a dipole 111 to 114. Since the cable halves which lead to the respectively adjacent mutually orthogonal dipole halves are electrically conductively connected at their feed point, this results in four interconnection points 15', 5", 15", 5' which are once again fed in a balanced manner, crossed over, as can also be seen in particular from the illustration in FIG. 5. The overall antenna element which results from this now acts electrically as a cruciform dipole by in-phase excitation of the half-dipole components 114*b*, 111*a*, of the half-dipole components 111*b* and 112*a*, and of 112*b* and 113*a*, as well as 113*b* and 114*a*. The specific arrangement of the cable halves which are each arranged parallel at a short distance apart from one another and through which the current flows in phase opposition ensures that the cable halves themselves do not produce any significant contribution to the radiation, that is to say with any radiation being cancelled out by overlapping.

Figure 2:
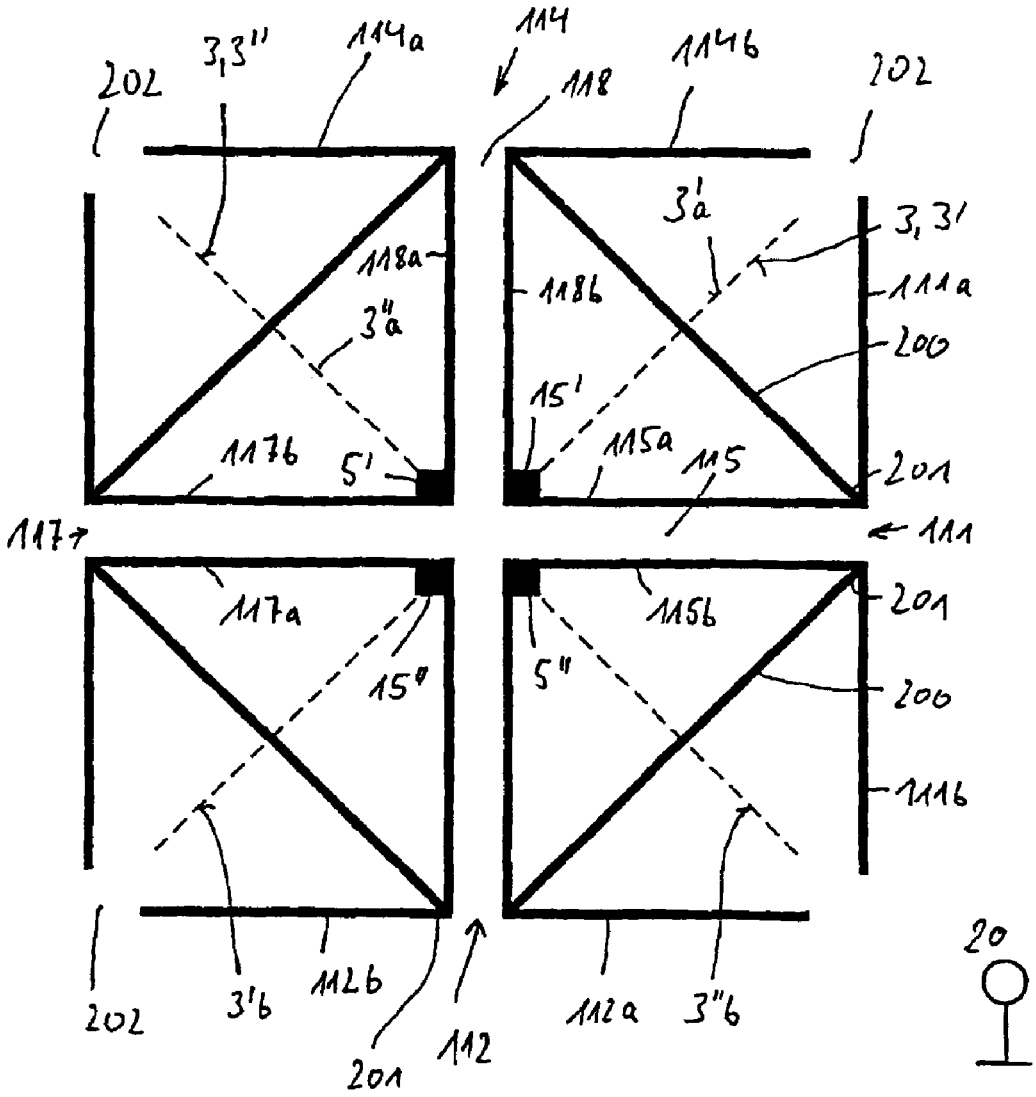
FIG. 2 shows a schematic plan view of a first exemplary non-limiting illustrative implementation of an antenna element arrangement.
Figure 2A:
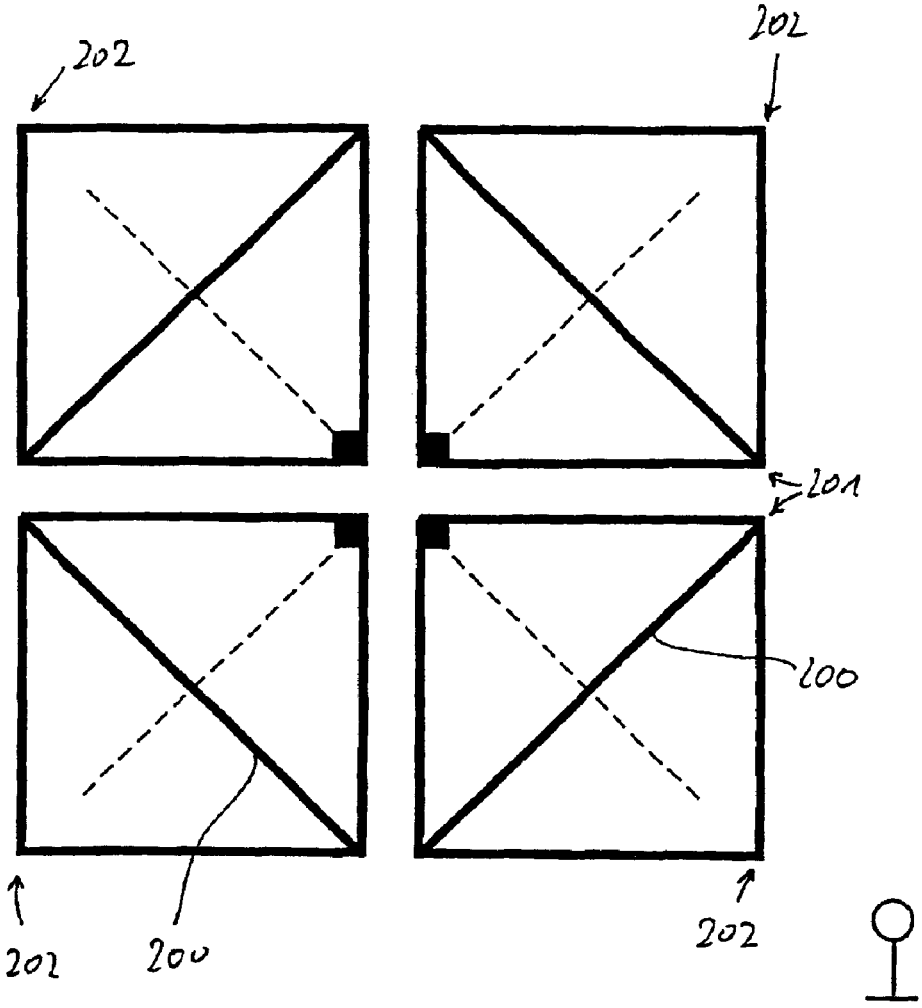
FIG. 2*a* shows an exemplary non-limiting illustrative implementation, modified from that in FIG. 2, corresponding to the plan view.

FIG. 2 shows the basic structure in a plan view of the antenna element arrangement, with the antenna element module having quadruple symmetry in a plan view. Two mutually perpendicular axes of symmetry are formed by the balanced lines 115 and 117 as well as 112 and 118, with the third and fourth axes of symmetry being rotated through 45° with respect to this in a plan view of the antenna element arrangement as shown in FIG. 2, and being formed by the dipoles 3' and 3" that result from the electrical point of view.

Figure 3:
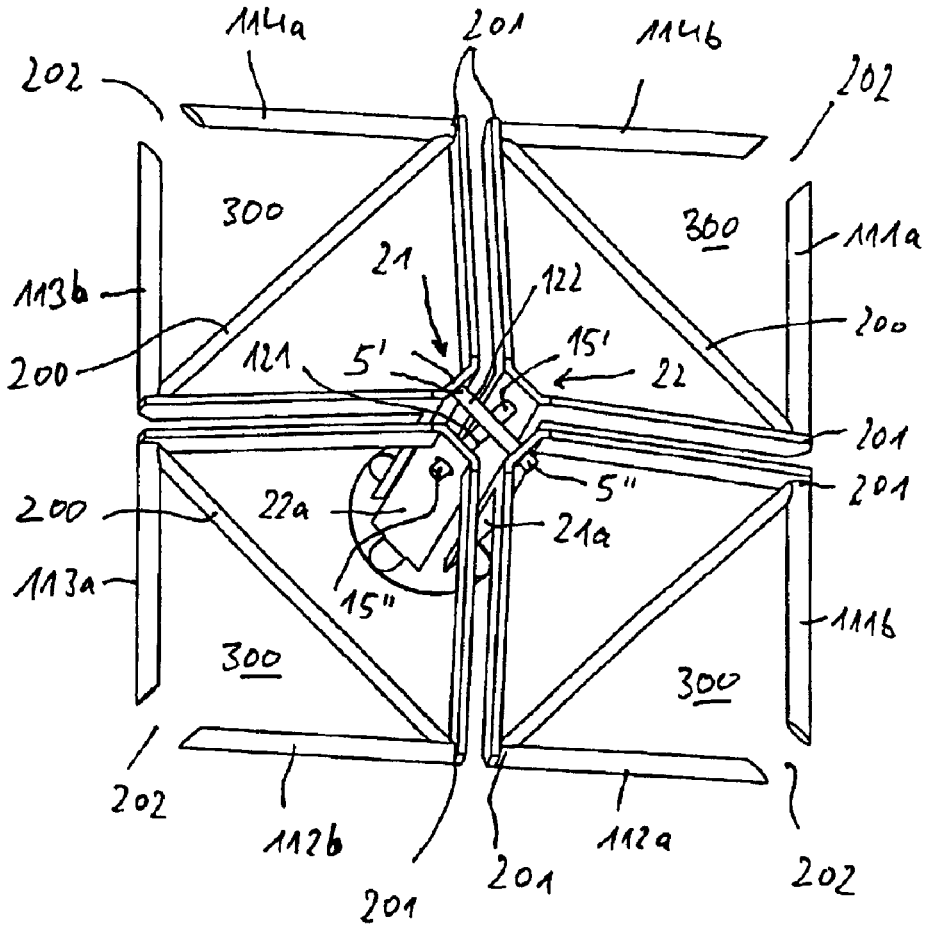
FIG. 3 shows a perspective illustration of a specifically shown exemplary non-limiting illustrative implementation of a dipole antenna element.
Figure 3A:
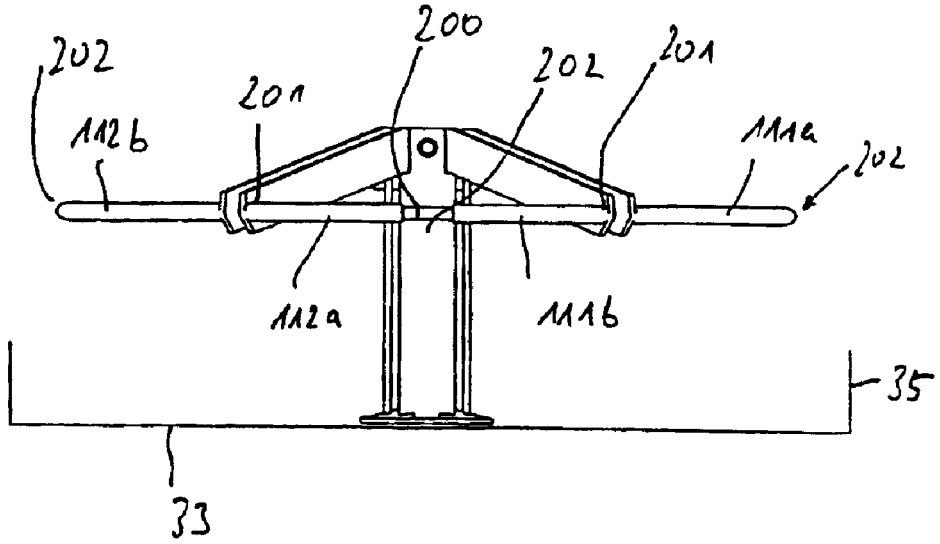
FIG. 3*a* shows a schematic side view of the dual-polarized dipole antenna element.

In addition, FIG. 3 also shows in each case one part of the balancing device 21 at the feed and interconnection point 5' and, a short distance away opposite the center point 5, the other part of the balancing device 21*a*, which on the one hand is used for mechanical attachment of the dipole structure to the reflector plate, and on the other hand allows the transition to unbalanced feed cables (for example coaxial cables) at the interconnection point.

In a corresponding manner, FIG. 3 in particular shows that the interconnection point 15' for the half-dipole components 114*b* and 111*a* as well as the opposite interconnection point 15" for the half-dipole components 112*b* and 113*a* are formed in the area of the balancing device 22 and, at 180° or opposite this, at the balancing device 22*a* which is likewise once again firstly used for mechanical attachment of the dipole structure to a rearward reflector plate 33, and on the other hand allows the transition to the unbalanced feed cable (or coaxial cable) at the interconnecting point. In this case, FIG. 3 in particular shows very well how the electrical feed is provided via a cross-over circuit with a first circuit link 121 and a second circuit link 122, which is located offset through 90° with respect to this, at the respectively opposite balancing devices 21 and 21*a*, as well as 22 and 22*a*. The last-mentioned circuit lines 121 and 122 are arranged at a vertical distance from one another, that is to say they are not electrically connected to one another.

In this case, FIG. 3 also shows that, by way of example, the link 122 which is in the form of a pin is mechanically firmly fitted to that half of the balancing device 22 which is located at the rear in FIG. 3, and is electrically connected there to the balancing device 22 while, in contrast, the opposite free end of this link, which is in the form of a pin, projects through a hole of appropriate size through the front half of the balancing device 22*a*, without needing to be electrically connected to this balancing device 22*a*. This makes it possible to route a coaxial cable for feed purposes in front of the balancing device 22*a*, to electrically link the outer conductor to the balancing device at some suitable point, to connect the inner conductor to the free end of the link 121, and to provide the feed in this way. The second part of the link 121 is also constructed in a corresponding manner, that is to say with its rearward end mechanically fitted to the balancing device 21 and electrically connected to it while, in contrast, the opposite free end projects through a larger hole without making electrical contact, beyond the balancing device 21*a* which is located at the front on the right in FIG. 3. There, the second coaxial cable can be laid, coming from underneath parallel to the balancing device, for example, with the outer conductor being electrically connected to the balancing device and with the inner conductor being connected to the free end of the link 121, which is in the form of a pin.

Merely for the sake of completeness, it should be mentioned that other connection options are likewise possible as well, for example in such a way that an inner conductor is passed from the bottom upwards between the respective balancing devices and is then electrically connected at some suitable point to the upper end of an associated balancing device in order to allow the symmetrical feed in this way. The outer conductor can also be routed over a part of this distance or else can be electrically connected at a lower level to the respectively opposite half of the balancing device. The possible implementations of the feed are to this extend explained only by way of example.

In other words, the feed in provided crossed-over between the feed points 5' and 5" and 15', 15". The electrical cable halves 115*a* to 118*b* which have been mentioned are in this case each arranged in pairs symmetrically with respect to one another, that is to say, the adjacent electrical cable halves of two adjacent half-dipole components in each case run parallel at a comparatively short distance apart from one another, with this distance preferably corresponding to the distance 55 between those ends which in each case point towards one another on the associated dipole halves, that is to say for example corresponding to the distance between those ends which point towards one another on the dipole halves 111*a,* 111*b,* etc. In principle, the cable halves may in this case run parallel to a rearward reflector plate in the plane of the half-dipole components. In contrast to this, the exemplary non-limiting illustrative implementation in FIGS. 2 and 3 shows an exemplary non-limiting implementation in which the cable halves, which also represent the holder device for the half-dipole components, are mounted such that they descend slightly starting from their associated balancing device and end at the same level as the half-dipole components, which can be arranged parallel to a rearward reflector plate 33. This depends on the waveband of the electromagnetic waves to be transmitted or received since the height of the balancing device above the reflector plate 33 should correspond approximately to $\lambda/4$ and, with regard to the radiation characteristic, it may possibly be desirable for the dipoles and dipole halves to be arranged closer to the reflector plate 33.

As a result of this arrangement, one dipole in this case always at the same time provides the +45° and the −45° polarization in which case, however, and in contrast to the physically geometric alignment of the individual half-dipole components in the horizontal and vertical directions, the resultant +45° polarization and −45° polarization are obtained only be the combination of the antenna element components, that is to say, in other words, the X-polarized cruciform dipole antenna element 3 which is shown, from the electrical point of view, in FIG. 2. The principle of the method of operation is that the currents on the supply lines or connecting lines which are in each case adjacent and are parallel to one another, are superimposed, that is to say for example the current on the electrical cable 115*b* being superimposed on the electrical cables 115*a,* and the current on the cable 116*a* having that on the electrical cable 116*b* superimposed on it, etc, with phase angles such that they do not also radiate, or also radiate only slightly, while, at the same time, the superimposition of the currents at the feed points means that the feed points (5', 5") are decoupled from the feed points (15', 15").

FIG. 1 shows how a dual-polarized dipole antenna element 1 as explained with reference to FIGS. 2 to 4 can also be used to form a corresponding antenna array with two or more dipole antenna elements 1 which are arranged, for example, one above the other in the vertical installation direction, and which overall describe an antenna with +45° and −45° polarization from the electrical point of view, despite the horizontally and vertically aligned half-dipole components.

The antenna element arrangements which are shown in FIG. 1 are each arranged with their associated balancing device on a reflector plate 33 which is provided, in the installation direction of the individual antenna element modules on the opposite sides, with electrically conductive edges 35 which run at right angles to the reflector plane.

It is possible to not provide the electrical feed to the dipole halves in the area of the balancing device and the cable halves which are electrically attached to the balancing devices 21, 21*a* and 22, 22*a* and which also carry out the holding function. In contrast to this, it is possible for the elements 115*a* to 118*b,* which are shown in FIGS. 2 to 5, to be in the form of nonconductive supporting elements for the dipole halves, and for the cables 115 to 118 to be routed directly from underneath through the reflector plate 33 to the connecting ends 215*a,* 215*b,* 216*a,* 216*b,* 217*a,* 217*b* and 218*a,* 218*b.* In this case, a symmetrical or virtually symmetrical separation is achieved at the feed point of the dipole halves, and the dipole halves are fed with the described phase angles with respect to one another. Furthermore, the feed lines may also run along or parallel to the wire elements. The preferred exemplary non-limiting illustrative implementation in this case is that in which the wire elements are at the same time electrically conductive and are used as feed lines. It is equally feasible for the supporting elements 115*a* to 118*b* for the dipole halves to be designed in a completely different manner from the physical point of view in a case as this and to be arranged such that they run differently, for example from the connecting points 215*a* to 218*b,* starting from the center of the dipole halves or from the corner region of the respective mutually perpendicular dipole halves vertically or at an angle downwards to the reflector 33, where they are mechanically anchored.

It is also feasible for the reflector itself to be in the form of a printed circuit board, that is to say by way of example to be in the form of the upper face of a printed circuit board on which the entire antenna arrangement is constructed. The corresponding feed can be provided on the rear face of the printed circuit board, with the electrical cable halves, starting from there, running on a suitable path to the connecting points 215*a* to 218*b* which have been mentioned. In order to achieve a radiation characteristic that is as good as possible, all that is necessary is to ensure that, irrespective of how they are routed to the connecting points at the dipole halves, these cable halves are as far as possible, that is to say essentially, or at least approximately aligned parallel to one another, in other words at least essentially or approximately resulting in a balanced line.

Figure 4:
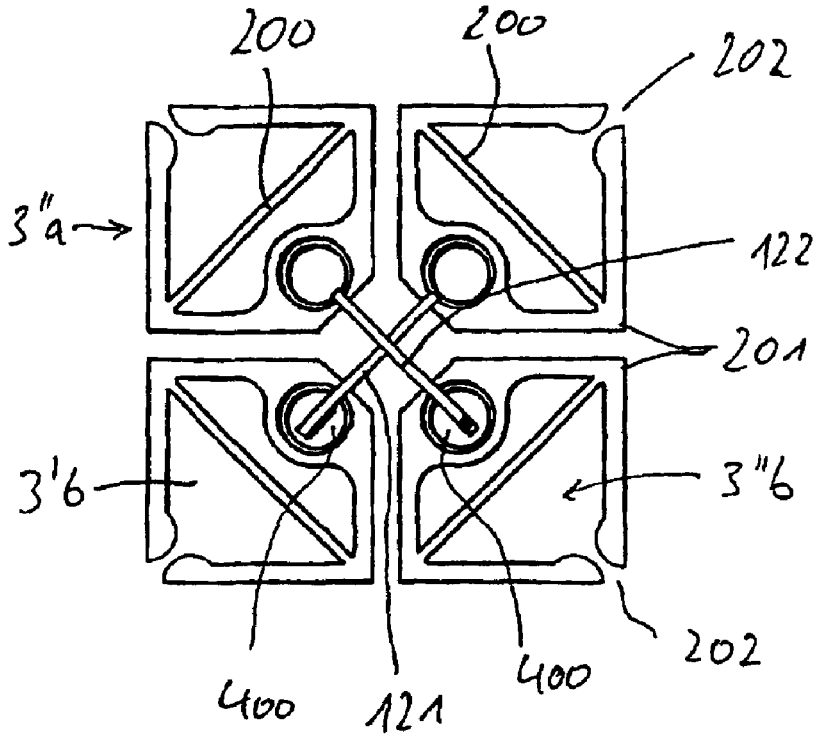
FIG. 4 shows a plan view of an antenna element arrangement, which has been slightly modified in comparison to the antenna element arrangements shown in the illustrations in FIG. 1, 2 or 3.

FIG. 4 shows a plan view of an antenna element arrangement which, in principle, is comparable to that antenna element arrangement which has been described with reference to FIG. 1, FIG. 2 and FIGS. 3 and 3*a*. The antenna element arrangement which is shown in the form of a plan view (that is to say at right angles to the reflector plane) in FIG. 4 has half-dipole components which end at a short distance from one another, without touching one another, in the outer corner regions 202. The half-dipole components may in this case be manufactured integrally. The transverse struts 200 which have been mentioned are an integral component of the respective dipole half. The plan view in FIG. 4 furthermore in this case shows the links 121 and 122, which are in the form of pins and are crossed over. The inner conductors of a coaxial cable for feeding the two polarizations can be passed up in channels or apertures 400 which run at right angles to the plane of the drawing or the reflector plane, with the outer conductor of the coaxial cable being formed directly by the metallic supporting structure, which is at the same time used for balancing, preferably at the upper end immediately in the connecting region while, in contrast, the inner conductor is electrically connected to the link 122 via which the opposite second dipole half 3"*a* is fed electrically. The structure itself in this case forms the outer conductor. The connection via a coaxial cable for the polarization that is located offset through 90° is likewise provided in such a way that the outer conductor of the coaxial cable is formed by the metallic structure itself in the other channel 400, and the outer conductor of the coaxial or feed cable is electrically connected at the upper end in the region of the dipole antenna elements to the associated dipole half 3*b*′ while, in contrast, the inner conductor is electrically connected to the link 121, which is electrically connected to the opposite dipole half 3′*a* via the other link 122, but without touching it.

Figure 5:
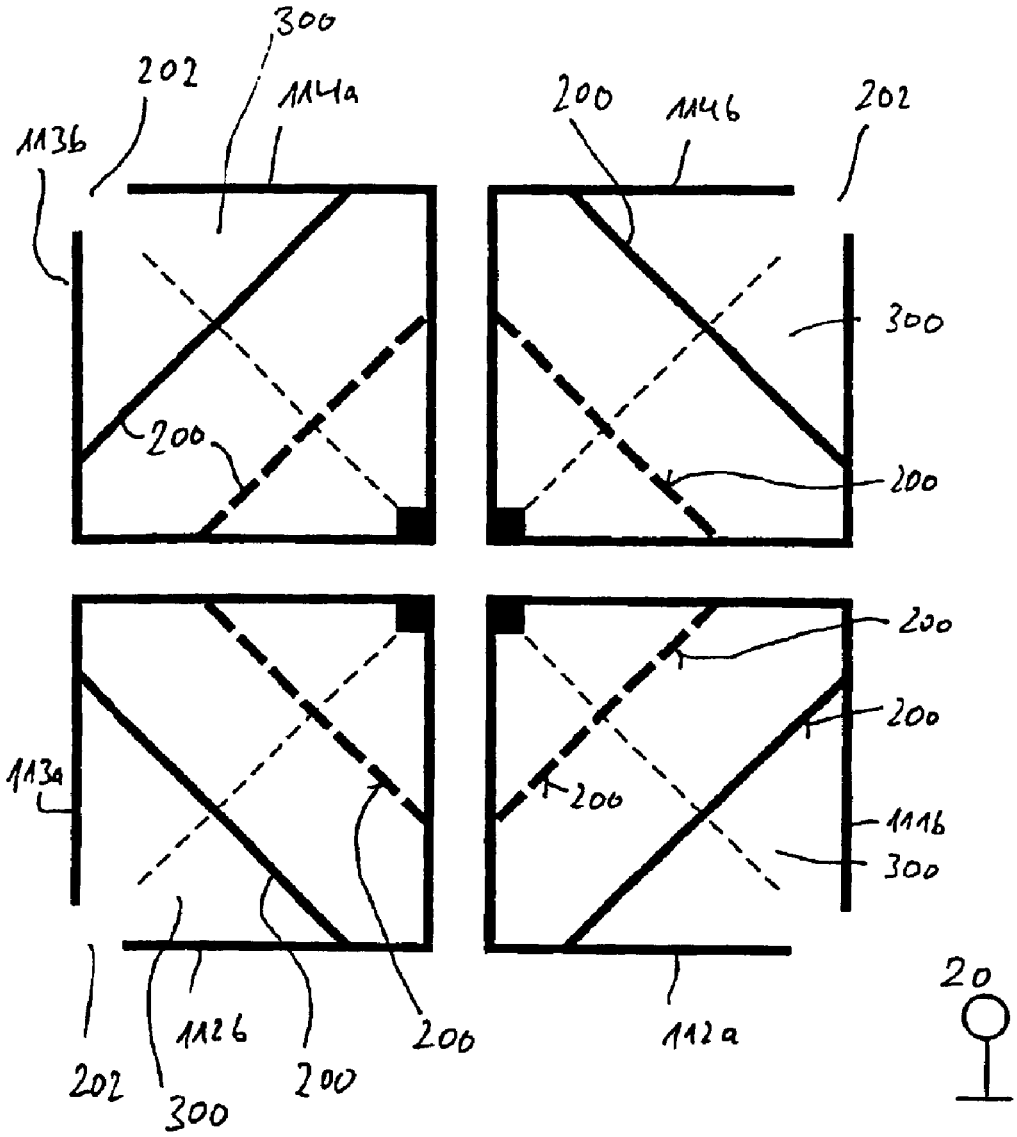
FIG. 5 shows a further exemplary non-limiting illustrative implementation, modified in comparison to FIG. 2.

As can be seen from the schematic plan view in FIG. 5, these electrical transverse struts 200, which electrically connect the two respectively interacting half-dipole components, may possibly also be arranged at a different point. In the exemplary non-limiting illustrative implementation shown in FIG. 5, these transverse struts 200 are arranged such that they are offset from their central position (as is shown in FIGS. 1 to 4) more towards their outer corner region 202. In this exemplary non-limiting illustrative implementation, however, they are still arranged transversely with respect to the respective polarization plane 3' and 3", that is to say at right angles to it. In some circumstances, the transverse struts 200 may also be arranged offset in the opposite direction (this is shown by way of example by dashed lines in FIG. 5), in which case the electrical connecting points 200' are not located on the half-dipole components and are not located at the end of the half-dipole components opposite their outer corner regions 202 but on balanced lines 115, 116, 117, 118, that is to say on the cable halves, which in each case interact in pairs, for one dipole half.

Figure 6:
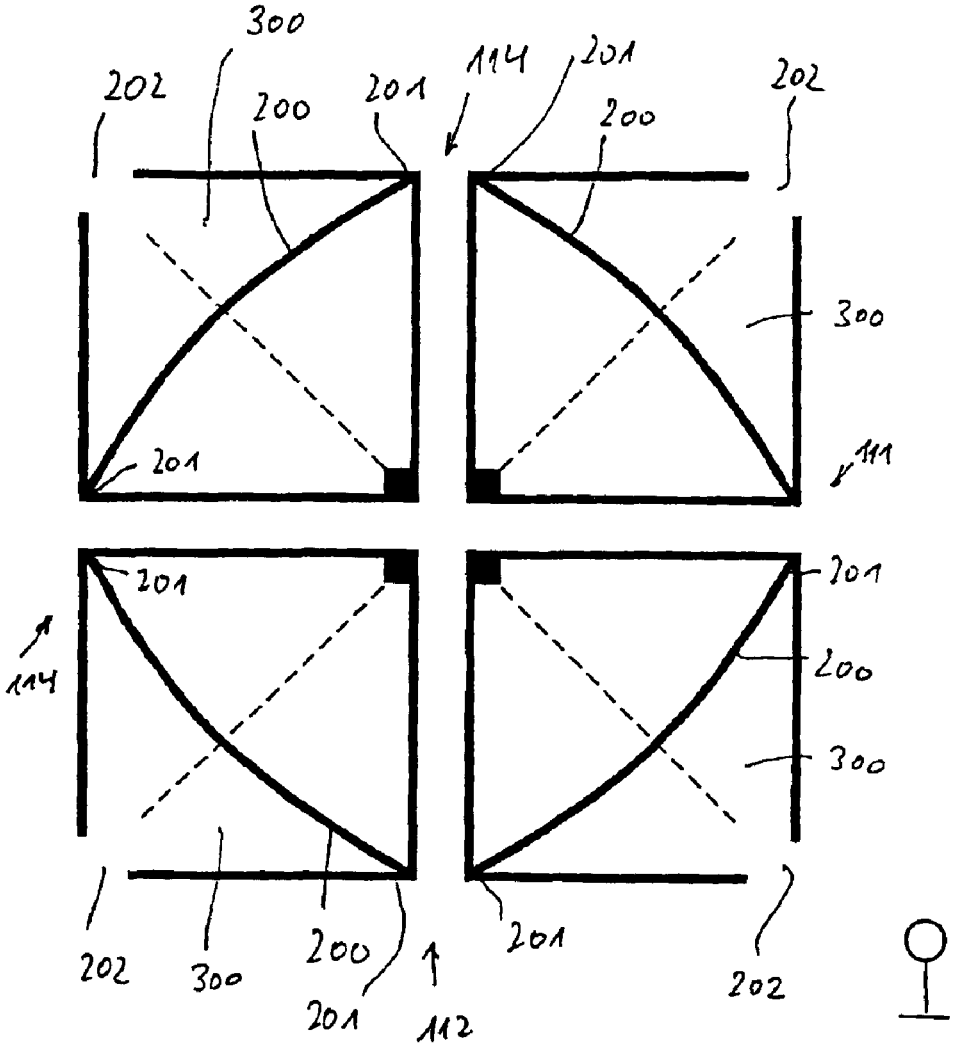
FIG. 6 shows a further exemplary non-limiting illustrative implementation, modified in comparison to FIG. 2 and FIG. 5.
Figure 7:
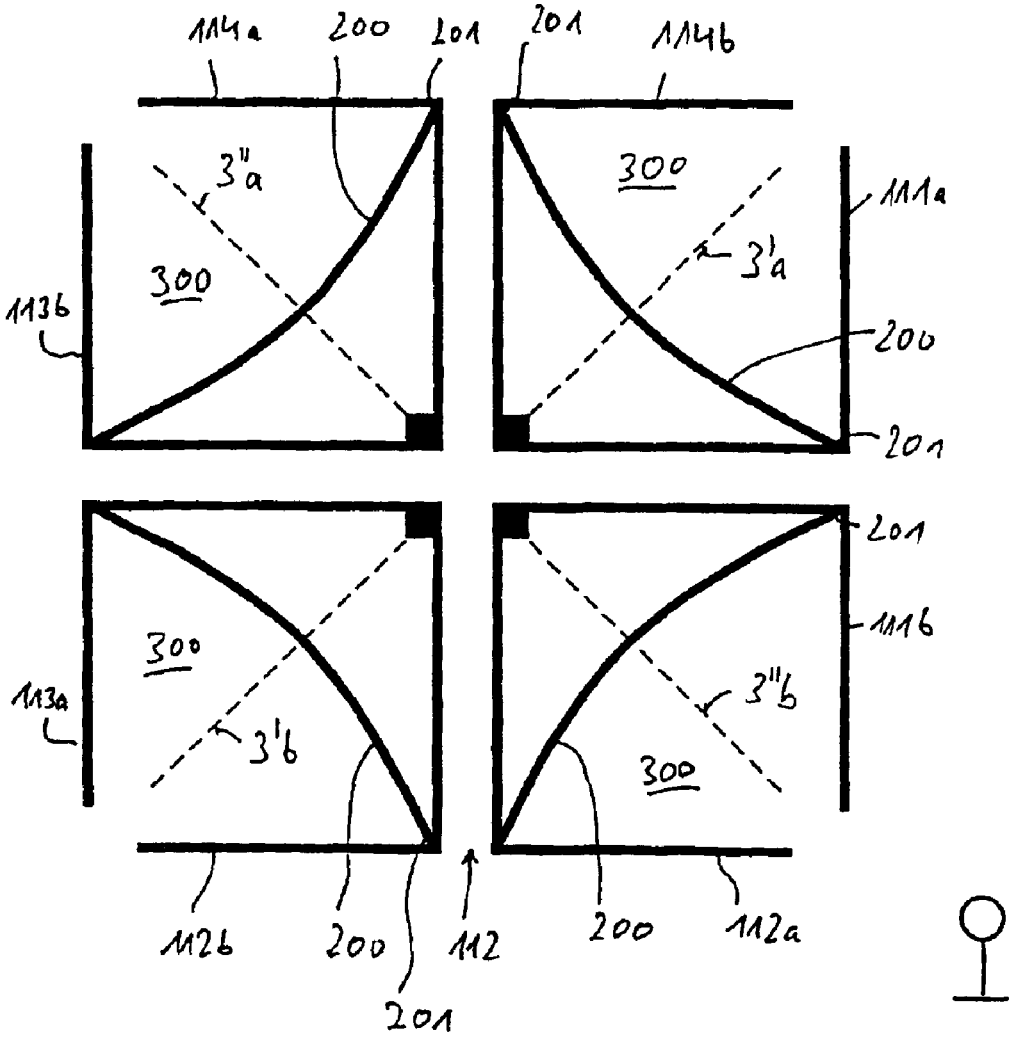
FIG. 7 shows a schematic plan view of a further modified exemplary non-limiting illustrative implementation.

As is shown in FIGS. 6 and 7, this electrical connection or transverse strut 200 need not necessarily run in a straight line. It is also possible for this electrical connection or transverse strut 200 to be formed to be at least slightly convex or concave, for example, in a plan view. The electrical cross connection or transverse strut 200 may likewise be designed and arranged to be at least slightly curved, such that the corresponding connecting section runs at least partially above or below the plane which is formed of half-dipole components.

Figure 8:
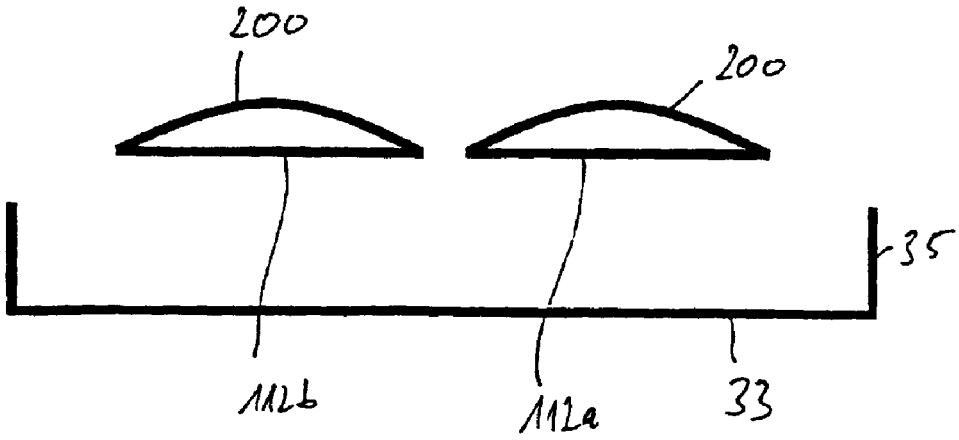
FIG. 8 shows a final further modified exemplary non-limiting illustrative implementation, in a view in the plane of the dipoles.
Figure 9:
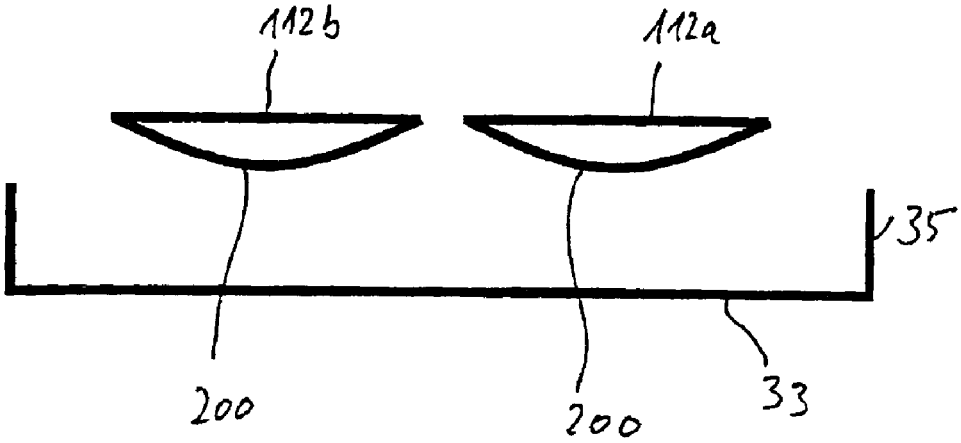
FIG. 9 shows an exemplary non-limiting illustrative implementation, slightly modified from that shown in FIG. 8, in a cross-sectional illustration transversely with respect to the reflector plane.

The vertical cross-sectional illustration transversely with respect to the plane of the reflector 33 as shown in FIG. 8 (and likewise in FIG. 9) shows that the transverse struts or cross connections 200 may also run in a curved shape upwards or downwards from the rest of the plane of the dipole halves (that is to say pointing away from or towards the reflector plate).

Figure 10:
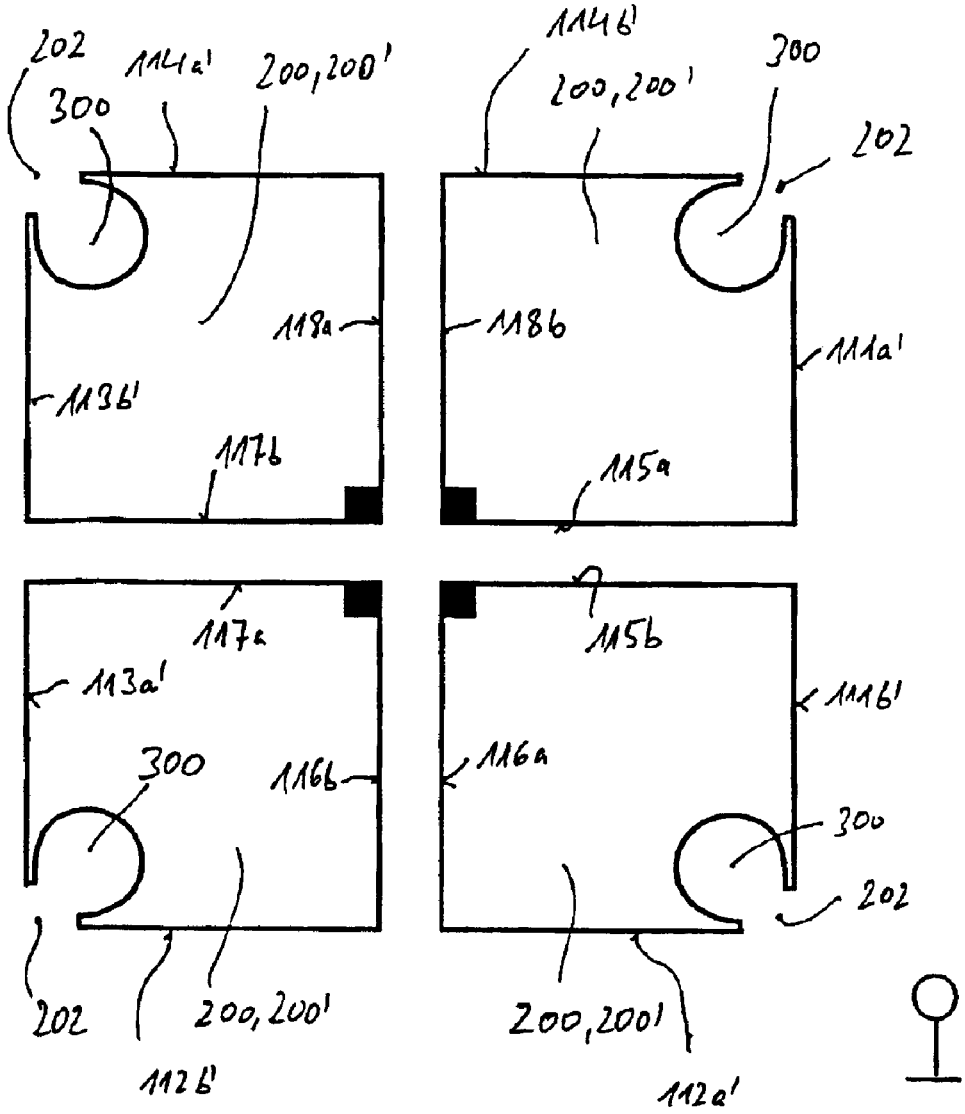
FIG. 10 shows a plan view of a modified exemplary non-limiting illustrative implementations with somewhat flat dipole halves.

FIG. 10 is a schematic plan view to show that a corresponding antenna element arrangement may also have dipole halves which, in plan view, likewise have square or approximately square structures, but in which the dipole surfaces in the inner area are not essentially free and empty but, instead, are in the form of a solid surface.

The transverse strut or cross connection 200 as explained with reference to FIGS. 1 to 9 is formed in the exemplary non-limiting illustrative implementation shown in FIG. 10 by a flat element 200', with the boundary edges 115*a*′ to 118*b*′ which in each case point towards one another being formed in the exemplary non-limiting illustrative implementations 1 to 9 by the balancing lines which run symmetrically and preferably parallel to one another. The boundary edges 111*a*' to 114*b*′ which point outwards correspond, in terms of their function, to the half-dipole components 111*a* to 114*b* shown in the exemplary non-limiting illustrative implementations in FIGS. 1 to 9. The opening area 300 in the flat dipole halves 3'*a* to 3"*b* are formed in the exemplary non-limiting illustrative implementations shown in FIGS. 1 to 9 by the corresponding opening area 300 which are [sic] formed by the transverse struts 200 shown there and by the half-dipole components 111*a* to 113*b* which in each case point upwards. In the exemplary non-limiting illustrative implementation shown in FIG. 10, the outer corner region 202 is preferably likewise open, so that the opening 300 is not bounded on the outside by this separation area 202 and, specifically from the electrical point of view, is not bounded such that it is closed. A nonconductive corner element, which is used only for mechanical robustness, may, however, be used, as is shown by dashed lines for the dipole half at the top on the right in plan view shown in FIG. 10.

What is claimed is:

1. A dual-polarized antenna element arrangement comprising:

at least two dipoles arranged in a dipole square, providing two mutually perpendicular diagonals, at least one balanced line feeding said dipoles, the dipoles being interleaved and fed such that the antenna element arrangement is electrically equivalent to a cruciform dipole providing two mutually perpendicular polarization planes running parallel to the two mutually perpendicular diagonals which are formed by the antenna element arrangement, the dipoles each having two mutually interacting half-dipole components providing a corner region remote from the center of the antenna element arrangement, said two half-dipole components being arranged such that they run transversely substantially at right angles to one another and end at a distance from one another in said corner region, a transverse strut coupled to the mutually interacting half-dipole components, the mutually interacting half-dipole components, being electrically connected via their feed point and also via a second connection with respect to said transverse strut, the transverse strut acting on the respective half-dipole components, and being offset with respect to the corner region.

2. The dual-polarized antenna element arrangement according to claim 1, wherein the transverse strut is electrically connected to a respectively associated half-dipole component furthest away from the corner region.

3. The dual-polarized antenna element arrangement according to claim 1, wherein an opening which passes through the plane of the associated dipole half is provided between the transverse strut and the outer corner region, the area of said opening corresponding to at least 20% of the total area of the associated dipole half, boundary edges which point outwards not being electrically connected to one another in the corner region.

4. A dual-polarized antenna element arrangement comprising:

a crucible dipole providing two mutually perpendicular polarization, the crucible dipole comprising flat dipole halves having side boundaries that point towards one another, the side boundaries of two adjacent dipole halves being symmetrical and arranged such that they run parallel to one another:

the dipole halves each having a square structure and defining an aperture whose size is at least 20% of the total area thereof, and the outer boundaries, pointing outwards and running at least approximately at right angles to one another, of an associated dipole half end at a distance from one another in an outer corner region such that, the aperture is electrically open to the outside over the outer corner region.

5. Dual-polarized antenna element arrangement according to claim 4, wherein the outer boundaries which point outwards comprise half-dipole components.

6. Dual-polarized antenna element arrangement according to claim 4, wherein the flat sections of the dipole halves form an electrical cross connection and are at least indirectly connected to the outer boundaries which point outwardly.

7. Dual-polarized antenna element arrangement according to claim 6, wherein the electrical cross connection is electrically connected to a respectively associated half-dipole component at a point which is linked to the outer corner region such that the electrical connecting point is located between the outer corner region and the opposite end half-dipole component.

8. Dual-polarized antenna element arrangement according to claim 7, wherein the electrical cross connection is straight.

9. Dual-polarized antenna element arrangement according to claim 6, wherein the electrical connection is provided with at least one curvature.

10. Dual-polarized antenna element arrangement according to claim 6, wherein the electrical cross connection is provided, in plan view, with at least one concave or convex curvature.

11. Dual-polarized antenna element arrangement according to claim 6, wherein the electrical connection lies in the plane in which the half-dipole components are also located.

12. Dual-polarized antenna element arrangement according to claim 6, wherein the electrical cross connection runs with at least one curvature such that at least one section of the electrical cross connection or transverse strut is located outside the plane in which the half-dipole components are arranged.

13. Dual-polarized antenna element arrangement according to claim 6, wherein the half-dipole components including the electrical cross connection are integral.

14. An improved bandwidth dual-polarized antenna comprising:

plural dipole squares electrically providing a crucible dipole exhibiting mutually perpendicular polarization planes, said dipole squares comprising half-dipole components;

a balanced feed point coupled to the dipole squares; and a transverse strut running transversely with said polarization planes, said transverse strut being coupled to said feed point and cross-connecting said dipole square half-dipole components.

* * * * *